United States Patent [19]

Provenzi

[11] Patent Number: 4,763,704

[45] Date of Patent: Aug. 16, 1988

[54] COMBINED VENEER TRIMMER AND ADHESIVE SPREADER MACHINE

[76] Inventor: Enrico Provenzi, Via Fanin, 20061 Carugate, Milano, Italy

[21] Appl. No.: 50,759

[22] Filed: May 15, 1987

[30] Foreign Application Priority Data

May 22, 1986 [IT] Italy ..... 20522 A/86

[51] Int. Cl.[4] ..... B27C 9/00; B27F 7/00

[52] U.S. Cl. ..... 144/3 R; 144/346; 144/350

[58] Field of Search ..... 144/2 R, 3 R, 116, 114, 144/117 R, 117 B, 345, 346, 352, 350

[56] References Cited

U.S. PATENT DOCUMENTS 691,267 1/1902 Hill ..... 144/116

FOREIGN PATENT DOCUMENTS 379386 7/1973 U.S.S.R. ..... 144/346
844290 7/1981 U.S.S.R. ..... 144/346
895662 1/1982 U.S.S.R. ..... 144/346

*Primary Examiner*—W. Donald Bray
*Attorney, Agent, or Firm*—Bucknam and Archer

[57] ABSTRACT

A combined veneer trimmer and adhesive spreader machine has a bed for supporting packs of veneers, over which bed moves a lower reciprocable conveyor belt which can be driven in synchronism with an upper reciprocable conveyor belt carried on a press member displaceable vertically and carried on a cross beam. Opposite longitudinal edges of the veneers in a stack held between the upper and lower reciprocable conveyor belts are trimmed by respective opposite blades each carried by a respective blade carrier which can be displaced along an inclined path under the action of a respective double acting fluid pressure cylinder so that the stack of veneers is cut whilst in horizontal motion without warping thereof due to the firm grip applied by the upper and lower reciprocable conveyor belts and the fact that the path of the cutter blades is inclined. Downstream of the upper and lower reciprocable conveyor belts there are provided vertical axis driven rollers capable of spreading a layer of an adhesive on the opposite cut edges of the veneers themselves.

6 Claims, 5 Drawing Sheets

COMBINED VENEER TRIMMER AND ADHESIVE SPREADER MACHINE

BACKGROUND OF THE INVENTION

Machines for trimming the edges of veneer sheets in a stack are equipped in such a way as to be able automatically to trim stacks of sheets of veneers along opposite edges of the sheets themselves. With such known cutting or trimming machines of conventional type, however, it can easily happen that difficulties arise in making the cuts which define the rectilinear opposite edges of the sheets, which edges have to be perfectly straight and parallel to fit together when the veneers are subsequently joined edge-to-edge. This arises because, during the cutting operation, the stack of veneers is not adequately restrained and therefore the various sheets can be subjected to unwanted warping phenomena. Consequently the edges may not be straight or parallel and therefore may not be able to fit together edge-to-edge in a proper relationship.

This connection, consequently, must necessarily be performed by overlapping the edges of the sheets with preliminary operations on the faces to conveniently taper the corresponding edges of the sheets.

OBJECTS OF THE INVENTION

The primary object of the present invention is that of eliminating the above-indicated disadvantages by providing a trimmer/spreader machine for the treatment of stacks of veneers, which is able to hold the treated stack firmly and in such a way as to allow a perfect cutting along two opposite sides of the stack to trim opposite edges of the veneers with great accuracy.

A secondary object of the present invention is that of providing a trimmer/spreader machine with which it is possible to obtain perfectly squared sheets of veneers, which sheets can therefore be correctly connected edgewise.

A further object of the present invention is that of providing a trimmer/spreader which is functionally very reliable.

SUMMARY OF THE INVENTION

The present invention provides a combined veneer trimmer and adhesive spreader machine for the treatment of stacks of veneers, comprising a lower bed and an upper press over the facing surfaces of which pass corresponding reciprocable lower and upper conveyor belts; two parallel, longitudinally extending blades lying one on either side of the position occupied by a stack of veneers on the said lower bed, and a plurality of rollers the axes of which are substantially perpendicular to the general plane of the individual sheets of veneer on the stack thereof, operable to spread a layer of appropriate adhesive onto opposite edges of the veneers.

Various other features and advantages of the present invention will become apparent from a study of the following descriptions of a preferred embodiment, in which reference is made to the accompanying drawings, provided purely by way of non-limitative example.

DESCRIPTION OF THE PREFERRED EMBODIMENT

Figure 1:
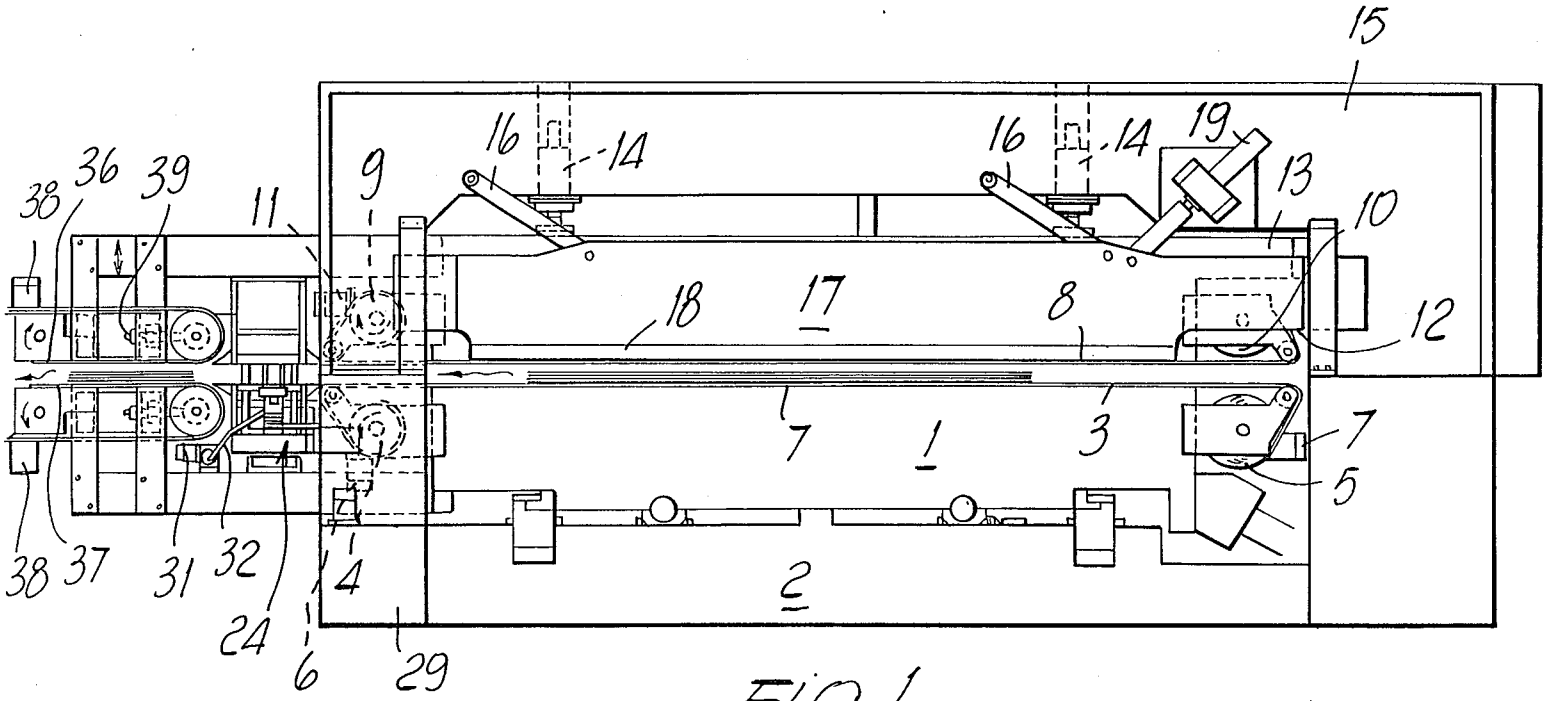
FIG. 1 is a schematic side view of a machine formed as an embodiment of the invention.
Figure 2:
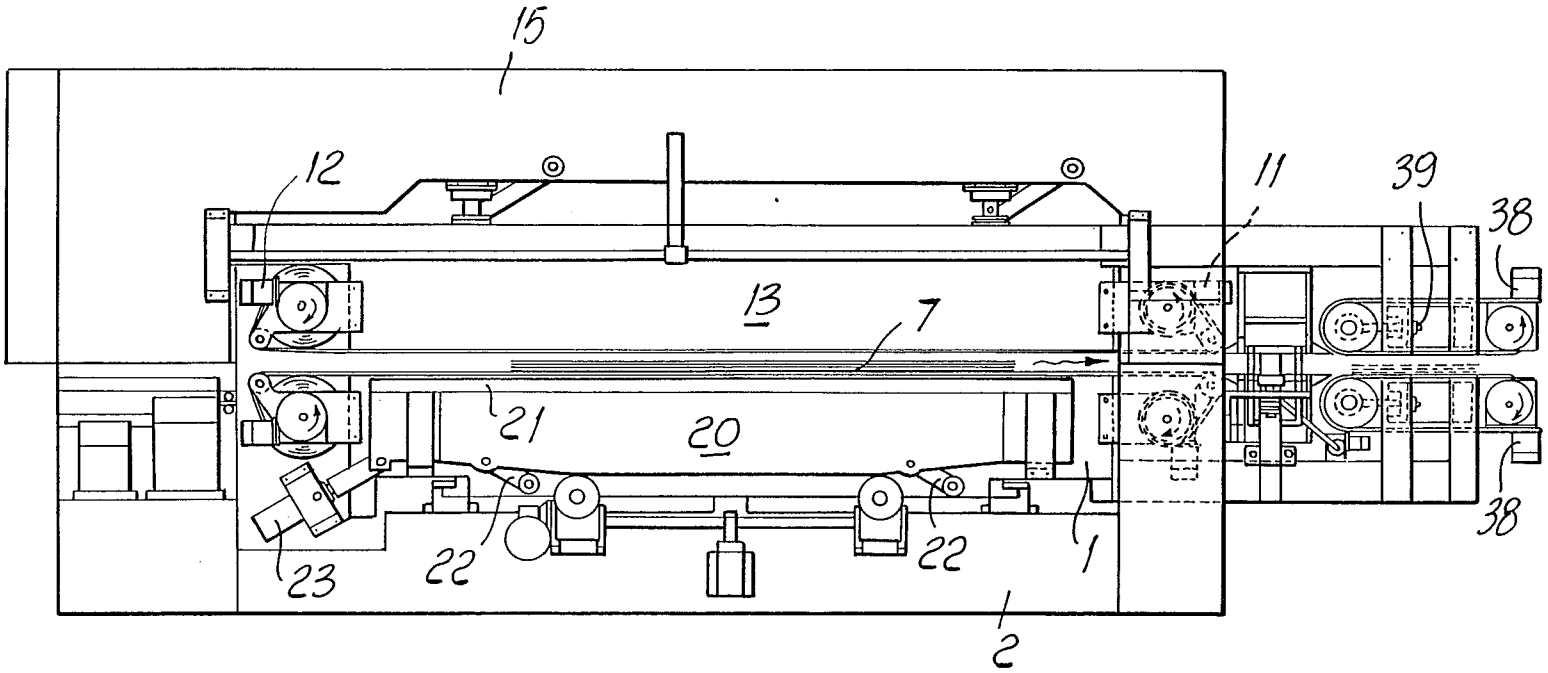
FIG. 2 is a further side view of the embodiment of FIG. 1, seen from the opposite side.

The trimmer/spreader machine illustrated in the drawings essentially comprises a movable bed 1, mounted on a base 2 and over which a conveyor belt 3 is slidable, this latter being driven to advance and retract by two rollers 4 and 5 over which respective ends of the conveyor belt 3 is wound. The rollers 4, 5 are driven to rotate by corresponding geared motor units 6, 7.

A stack of veneers 7 to be trimmed is carried on the first conveyor belt 3. Above the first conveyor belt 3 is a second conveyor belt 8, also driven with reciprocating motion by pairs of rollers 9 and 10 which are themselves driven by corresponding geared motor units 11, which are carried on a press 13 suspended via actuating cylinders 14 from a cross beam 15. This latter also carries an upper blade carrier 17 by means of pivoted arms 16, the upper blade carrier 17 carrying a blade 18 and being capable of translating downwardly along an inclined path under the action of a double acting cylinder 19.

Figure 5:
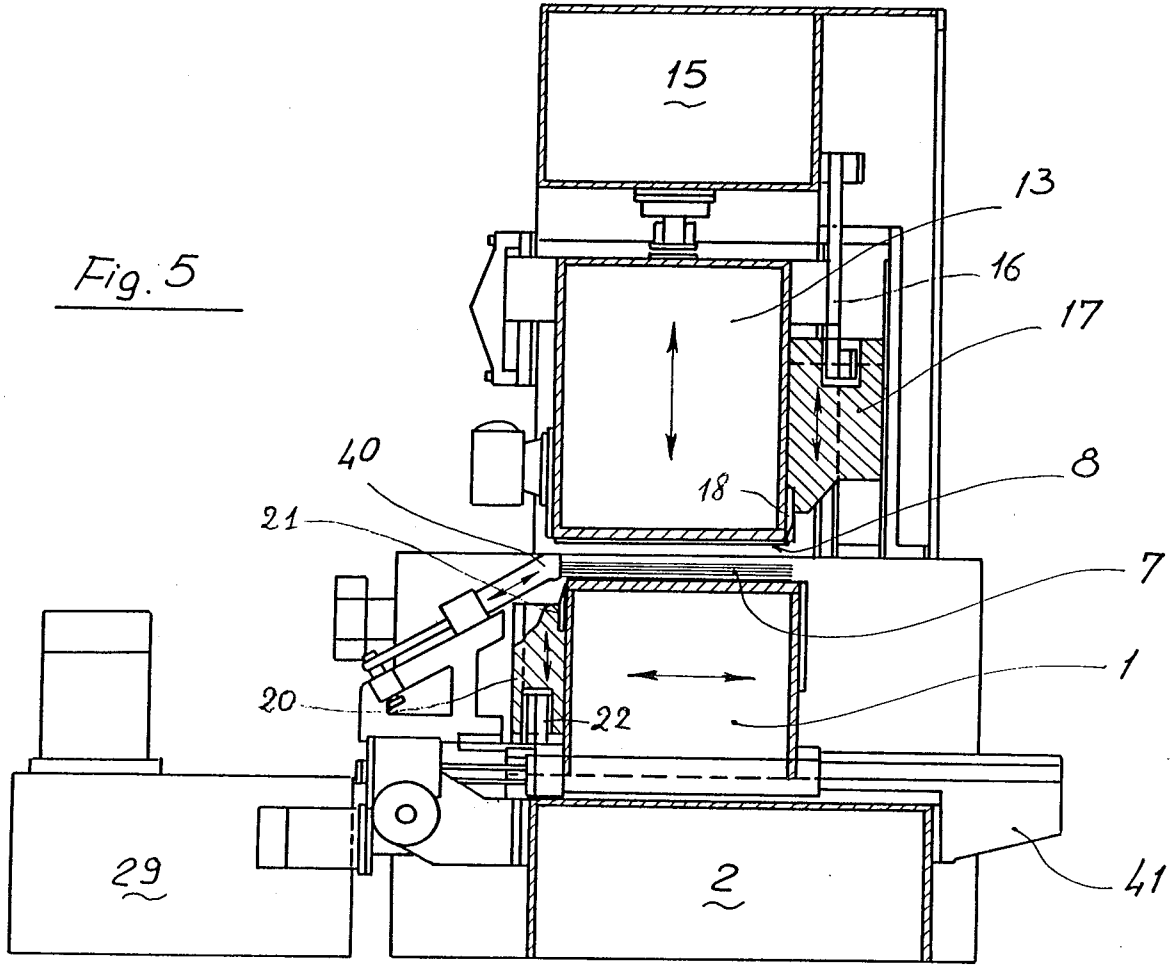
FIG. 5 is a rear view of the machine of the invention.

A similar lower blade carrier 20 with associated lower blade 21 is articulated to the base 2 by means of arms 22 and is displaceable upwardly at an angle by a further actuator cylinder 23. As can be seen in FIG. 5 the upper blade 18 carried on the upper blade carrier 17 acts on one longitudinal edge of the stack 7 whilst the lower blade 21 carried on the lower blade carrier 20 acts on the opposite longitudinal edge of the stack.

Downstream of the conveyor belts 3, 8 there is provided an adhesive-spreading apparatus, generally indicated 24 operable to spread a layer of an appropriate adhesive onto the two opposite trimmed sides of the stack 7 of veneers. This apparatus substantially comprises spreader rollers 25 and metering rollers 26 in contact with one another and mounted with their axes vertical on supports comprising, respectively, fixed supports 27 and movable supports 28 in such a way as to be able to adapt themselves to the width of the stack of veneers. They are shown in their position of closest approach in the plan view of FIG. 3. The rotation of the rollers 25, 26 which are supplied with adhesive from an appropriate reservoir 29 by means (not shown) is effected by means of a geared motor 31 and a flexible drive shaft 32. Beneath the rollers 25, 26 is a collection vessel 30 which removes surplus adhesive.

Above the movable bed 1 and beneath the press 13 are respective guides 33 and 34 for guiding corresponding series of rollers 35 operable to appropriately compress the stack of veneer. Downstream of the spreading apparatus there is provided a further pair of conveyor belts, respectively an upper continuous belt 36 and a lower continuous belt 37 driven by corresponding geared motors 38 and provided with appropriate devices 39 for regulating their tension.

Figure 3:
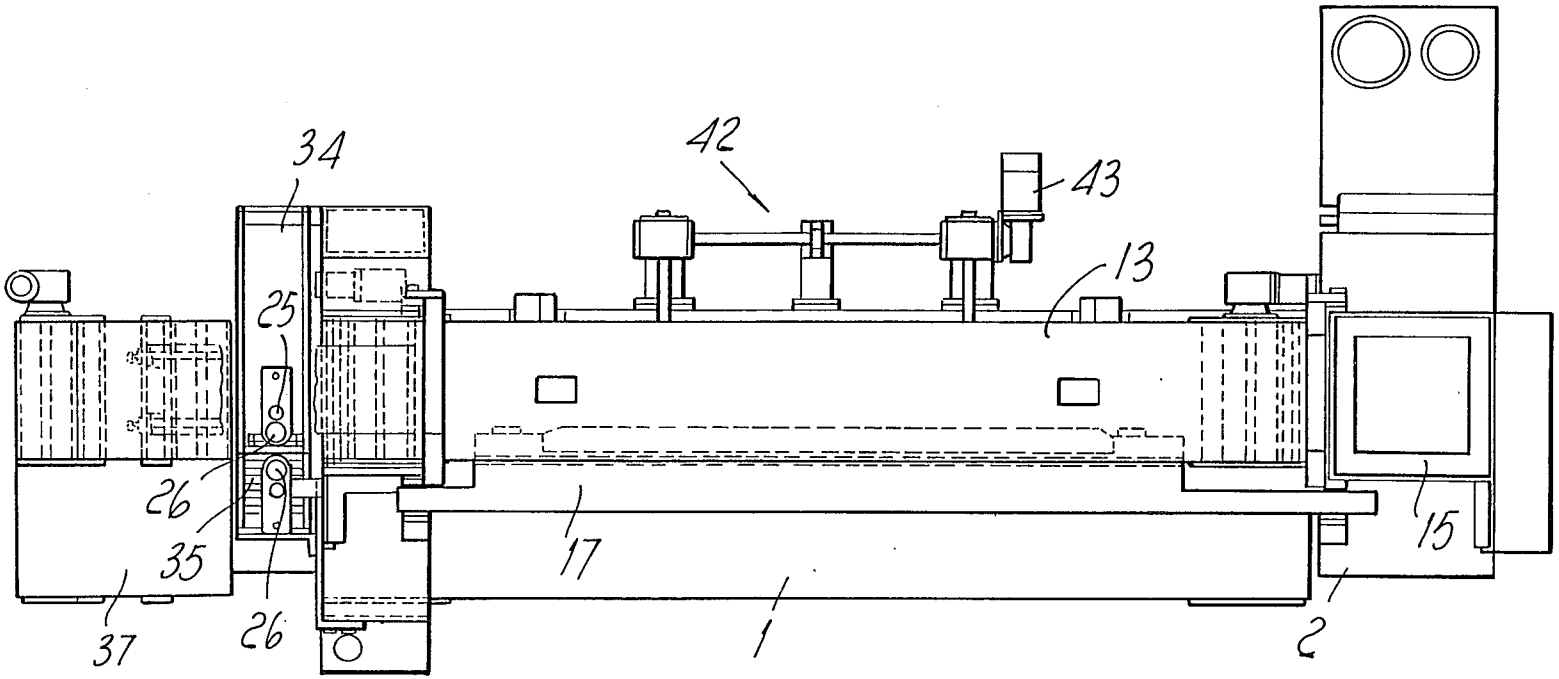
FIG. 3 is a plan view of the embodiment of FIGS. 1 and 2.
Figure 4:
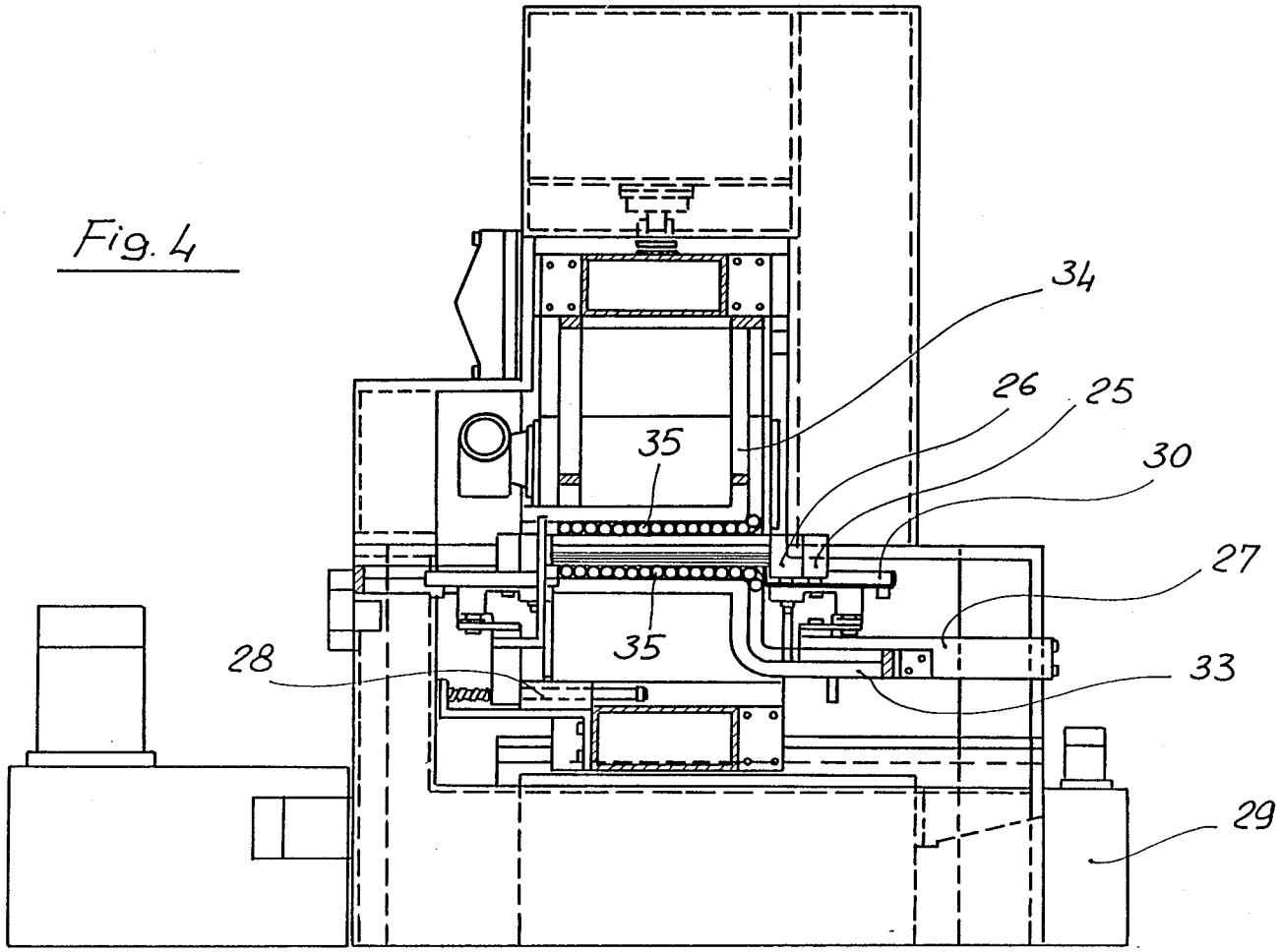
FIG. 4 is a front view of the machine of the invention.

In FIG. 5 can be seen a lateral adjustment member 40 capable of acting on the pack of veneers to adjust its lateral position on the bed 1, and a guide 41 for guiding translation in the horizontal plane of the movable bed 1, such translation movements being effected by suitable mechanisms, generally indicated 42 driven by an appropriate geared motor 43 (see FIG. 3).

What is claimed is:

1. A combined veneer trimmer and adhesive spreader machine for the treatment of stacks of veneers, said machine comprising:

a lower bed for supporting a stack of veneers to be treated, a lower reciprocable conveyor belt overlying said lower bed and carrying said stack of veneers, an upper press above said lower bed, an upper reciprocable conveyor belt passing over the face of said upper press facing towards said lower bed, first and second parallel longitudinally extending blades, said first longitudinally extending blade lying on one side of the position occupied by said stack of veneers on said lower conveyor belt and said second longitudinally extending blade lying on the other side of the position occupied by said stack of veneers on said lower conveyor belt, a plurality of adhesive spreader rollers having respective axes of rotation which are substantially perpendicular to the general plane of the individual sheets of veneer on said stack thereof, said adhesive spreader rollers being located downstream of said lower and upper reciprocable conveyor belts and being operable to spread a layer of adhesive onto opposite edges of said veneers.

2. The combined veneer trimmer and adhesive spreader machine of claim 1, wherein said lower bed is mounted on a base, means for displacing said lower bed and said lower reciprocable conveyor belt laterally with respect to said bed, first and second conveyor belt rollers carried on said lower bed, said lower reciprocable conveyor belt being wound at each end over said first and second conveyor belt rollers first and second geared motor units driving said first and second conveyor belt rollers, third and fourth conveyor belt rollers carried on said upper press, said upper reciprocable conveyor belt being wound at each end over said third and fourth conveyor belt rollers respectively, and third and fourth geared motor units driving said third and fourth conveyor belt rollers.

3. The combined veneer trimmer and adhesive spreader machine of claim 2 wherein said third and fourth conveyor belt rollers are carried on said upper press, a fixed beam, fluid pressure actuator cylinders supporting said press on said fixed beam, a plurality of first arms pivoted to said fixed beam, an upper blade carrier pivotally mounted to said pivoted arms, said upper blade carrier supporting said first longitudinally extending blade on a first side of said position occupied by said stack of veneers on said lower reciprocable conveyor belt, actuator means for displacing said upper blade carrier along a path inclined at an angle to said beam, a plurality of second arms pivoted to said base, a lower blade carrier pivotally connected to said second arms and carrying said second longitudinally extending blade, and actuator means connected between said base and said second blade carrier for displacing said second blade carrier and said second blade along an upwardly inclined path towards said stack of veneers.

4. The combined veneer trimmer and adhesive spreader machine of claim 1, wherein said adhesive spreader rollers for spreading a layer of adhesive onto said opposite edges of veneers in said stack of veneers comprise respective pairs of rollers a first of which is a spreader roller and a second of which is a metering roller said first and second rollers being adjacent one another and mounted with their axes vertical, at least one said pair of rollers being mounted on movable supports whereby to be able to adapt their position to accommodate stacks of veneers of different width.

5. The combined veneer trimmer and adhesive spreader machine of claim 1, wherein downstream of said adhesive spreader rollers there is provided a further pair of conveyor belts, said further pair of conveyor belts comprising an upper continuous conveyor belt and a lower continuous conveyor belt, respective upper and lower geared motor units driving said upper and lower continuous conveyor belts, and respective upper and lower belt tension regulation devices regulating the tensions of said upper and lower continuous conveyor belts

6. The combined veneer trimmer and adhesive spreader machine of claim 1, wherein said lower bed is laterally displaceable with respect to said base and said machine includes an adjustment member operable to engage one side of said pack of veneers on said bed, a horizontal guide for guiding said movable bed in a horizontal plane, and a geared motor unit for effecting lateral displacement of said bed.

* * * * *